US009586073B2

(12) United States Patent
Walker

(10) Patent No.: US 9,586,073 B2
(45) Date of Patent: Mar. 7, 2017

(54) VARIABLE WEIGHT HAMMER USEFUL AS EXERCISE APPARATUS

(71) Applicant: ManHammer Company, LLC, Middletown, DE (US)

(72) Inventor: Joseph Walker, Middletown, DE (US)

(73) Assignee: Manhammer Company, LLC, Middletown, DE (US)

( * ) Notice: Subject to any disclaimer, the term of this patent is extended or adjusted under 35 U.S.C. 154(b) by 163 days.

(21) Appl. No.: 13/965,281

(22) Filed: Aug. 13, 2013

(65) Prior Publication Data

US 2014/0051554 A1 Feb. 20, 2014

Related U.S. Application Data

(60) Provisional application No. 61/682,752, filed on Aug. 13, 2012.

(51) Int. Cl.

| | |
|---|---|
| ***A63B 21/00*** | (2006.01) |
| ***A63B 15/00*** | (2006.01) |
| ***A63B 21/075*** | (2006.01) |
| ***A63B 21/072*** | (2006.01) |
| ***A63B 23/035*** | (2006.01) |

(52) U.S. Cl.

CPC ..... *A63B 15/00* (2013.01); *A63B 21/072* (2013.01); *A63B 21/075* (2013.01); *A63B 21/0728* (2013.01); *A63B 21/4035* (2015.10); *A63B 23/03525* (2013.01); *A63B 2225/09* (2013.01)

(58) Field of Classification Search

CPC ..... A63B 21/00

USPC ..... 482/106, 107, 108, 109

See application file for complete search history.

(56) References Cited

U.S. PATENT DOCUMENTS

| | | | | |
|---|---|---|---|---|
| 115,856 | A | 6/1871 | Hiester et al. | |
| 712,634 | A | 11/1902 | Aronstein | |
| 2,396,408 | A | 4/1945 | Benecke | |
| 4,592,545 | A | 6/1986 | Sagedahl et al. | |
| 4,602,788 | A | 7/1986 | Wendt | |
| 5,121,925 | A * | 6/1992 | Blundo | A63B 69/3632 473/242 |
| 5,441,471 | A | 8/1995 | Passer | |
| 5,628,713 | A | 5/1997 | Wilkinson | |
| 5,788,608 | A | 8/1998 | Wilkinson | |
| 5,873,783 | A | 2/1999 | McBain et al. | |
| D428,461 | S * | 7/2000 | Koszalinski | D21/791 |
| 8,182,401 | B2 | 5/2012 | Clemons | |

(Continued)

FOREIGN PATENT DOCUMENTS

CN 2341631 Y 8/1999

*Primary Examiner* — Jerome W Donnelly

(74) *Attorney, Agent, or Firm* — Flaster/Greenberg PC

(57) ABSTRACT

An apparatus and methods of using the apparatus are included herein which apparatus includes a longitudinally extending bar body having an exterior surface and extending from a gripping end on a first bar section thereof to a second end comprising a hammer portion; wherein the hammer portion comprises a hammer head and the bar body comprises a second bar section extending from the hammer head at least partially along the bar body configured for receiving at least one weight positioned adjacent the hammer head. The apparatus is useful, for example, as a strength training fitness apparatus, a construction or demolition tool capable of supporting variable weight, and/or a strength training device for training workers.

36 Claims, 5 Drawing Sheets

(56) References Cited

U.S. PATENT DOCUMENTS

| | | | |
|---|---|---|---|
| 2004/0259698 | A1 | 12/2004 | Reilly |
| 2012/0149539 | A1 | 6/2012 | Quader |

* cited by examiner

VARIABLE WEIGHT HAMMER USEFUL AS EXERCISE APPARATUS

CROSS-REFERENCE TO RELATED APPLICATIONS

This application claims the benefit under 35 U.S.C. §119 (e) to U.S. Provisional Patent Application No. 61/682,752, filed Aug. 13, 2013, the entire disclosure of which is incorporated herein by reference.

BACKGROUND OF THE INVENTION

Field of the Invention

The invention relates to the fields of exercise equipment, specifically equipment for strength and core training based on hammer motion exercise, and hand held devices such as tools, which may be used other construction or building purposes, such as demolition work.

Description of Related Art

Weight-lifting and strength training for improvement to upper body, core and overall muscular groups is increasingly popular. The desire to build and sculpt the human musculature for overall strength and well-being is a focus of a large amount of specialty exercise equipment, both electronic weight training machines, resistance machines, and traditional free weights. Free weights operate by incorporating a central bar having typically a knurled portion for resistance to slip on the end areas thereof, for receiving one or more weights in the form typically of circular plates or discs having a hole through the center thereof to receive the bar. Such assemblies are also known as barbells. Free weights allow for changing the amount of weight applied by addition or removal of weights.

In use, a person exercising can use varied length bars and amounts and number of weights to bench press, lift, and do other exercises. In most cases a holding bar and/or bench may be used for certain exercises. Hand weights are also known that can be of a fixed weight (dumbbells having a solid core and fixed overall weight) or having the ability to interchange the ends are also known. Such smaller free weights can be used for arm exercises as well as upper body and back exercises.

Interchangeable weights are generally held on a bar using a tightenable collar. Weights may be polymeric on the outside and filled with sand or other substances on the inside, hard rubbers which may have an open or filled interior, solid and/or cast metals and metal alloys.

In the desire for further and further specialized fitness options, various specialty workouts have been developed. One recent development is exercise based on hammer motion such as the motion used in operating a large mallet or sledgehammer. Such exercise is itself not new, having been a source of exercise at the turn of the last century. However, it fell out of favor and is enjoying a revival of sorts based on new exercise trends and equipment. New developments are based on equipment which can enable the swinging force action with the involvement of resistance weights, while finding a way to minimize recoil impact from striking an object.

For example, U.S. Pat. No. 8,182,401 of Clemons teaches an impact-receiving member having a shock-absorbing mechanism therein so that if one is exercising using a hammer device the impact is dissipated energy to help ensure that can cause injury. A similar device can be found in U.S. Pat. No. 712,623 of Aronstein developed in 1902, wherein a user is training for drill-striking and also getting exercise by hammering against a base in which uses a rubber collar to absorb recoil. Other early developments from as early as 1871 using weighted clubs for exercise may be found in U.S. Pat. No. 115,856. A similar weighted club for strengthening a golf swing may be found in U.S. Pat. No. 2,396,408.

A new version of this revived exercise trend can be seen in U.S. Published Patent Application No. US 2012/0149539 A1 of Quader. Quader has attempted to balance the impact and recoil effect against the power needed for exercise by forming a strength training apparatus using an elongated handle with grip and having a headpiece on the other end thereof formed of elastic material that may have a bladder therein, and may also include various weighted headpieces that can be interchangeable.

While new devices are developing for safely taking advantage of traditional physical labor movements for upper body, core, back and all-around physical strength training, such devices require a lot of adaptation or specialty materials. There is a need in the art for a simple device that can enable a unique exercise program using the sledgehammer-type motion, while keeping the overall cost of the device reasonable for average users and making the device easy to manufacture. Such a device can also be used for training workers and/or as a tool for construction or similar purposes.

BRIEF SUMMARY OF THE INVENTION

The problems of the prior art are solved herein by an inexpensive to manufacture and easy-to-use hammering and strength training apparatus that can accommodate use of standard plate and disc weights known in the art or be used without weights for an upper body, core and overall fitness workout including various exercises.

The invention includes an apparatus, comprising a longitudinally extending bar body having an exterior surface and extending from a gripping end on a first bar section thereof to a second end comprising a hammer portion; wherein the hammer portion comprises a hammer head and the bar body comprises a second bar section extending from the hammer head at least partially along the bar body configured for receiving at least one weight positioned adjacent the hammer head. The apparatus may further include a collar for tightening at least one weight against the hammer head.

The apparatus may be a strength training apparatus, a construction or demolition tool capable of supporting variable weight, a strength training device for training workers or used for other purposes.

The bar body may comprise metal and may have a generally circular cross-section taken in a transverse direction across the bar body. The exterior surface of the bar body on the gripping end may comprise a roughened portion to resist slipping from a user's grip when in use. The gripping end may also comprise a gripping handle securely attachable or attached to the bar body.

The second bar section of the bar body is preferably integral with the first bar section of the bar body, and may also be a unitary one-piece structure with the first bar section of the bar body. The second bar section of the bar body may in one embodiment have a width that is larger than a width of the first bar section.

The hammer head may be configured so as to be generally circular in transverse cross section on extending portions thereof. The hammer head may also be configured so as to be generally square in cross section taken in a transverse direction across the hammer head and/or generally rectangular in cross section taken in a longitudinal direction across the hammer head. 16. In one embodiment, the hammer head may also be configured so as to be generally rectangular in cross section taken in a longitudinal direction across the hammer head and generally circular in cross-section taken in a transverse direction across the hammer head so that the hammer head is generally disc-shaped.

The second bar section may have an at least partially roughened exterior surface to resist slipping of weights when installed on the second bar section. The second bar section may also include threads along at least a portion of the exterior surface in the second bar section of the bar body for engaging mating threads on a collar for tightening weights against the hammer head. The second bar section may also be configured to have a width for receiving weight discs and that is larger than a width of the first bar section, but which has a smooth exterior surface.

A length of the bar body measured from a top surface of the hammer head to a gripping end of the first bar section of the bar body in a longitudinal direction along the apparatus is preferably about 16 in. to about 48 in. and more preferably about 24 in. to about 42 in. The length of the second bar section of the bar body measured in a longitudinal direction along the apparatus is preferably about 4 in. to about 20 in. The width as measured transversely across the bar body in the first bar section thereof is preferably about 0.5 in. to about 3 in., and a width measured transversely across the bar body in the second bar section thereof is preferably about 1 in. to about 4 in. The width of the second bar section of the bar body may increase from a first end of the second bar section towards the hammer head.

The weight of the apparatus in an embodiment may be about 5 lbs. to about 60 lbs., and the weight of the hammer head may be about 5 lbs. to about 30 lbs.

The invention also includes an assembly apparatus, comprising (a) a hammer head apparatus comprising: a longitudinally extending bar body having an exterior surface and extending from a first gripping end on a first bar section thereof to a second end comprising a hammer portion; wherein the hammer portion comprises a hammer head and the bar body comprises a second bar section extending from the hammer head at least partially along the bar body, the second bar section configured for receiving at least one weight and a collar for tightening at least one weight against the hammer head; (b) at least one weight disc having an opening therethrough sized to fit over the exterior surface of the bar body in the second bar body section thereof; and (c) a collar configured to retain the at least one weight disc on the bar body.

The assembly apparatus may a strength training apparatus, a construction or demolition tool and the at least one weight disc can be varied, or a strength training device for training workers.

The exterior surface of the bar body on the gripping end of the apparatus may comprise a roughened portion to resist slipping from a user's grip when in use.

The second bar section may have an at least partially roughened exterior surface to resist slipping of weights when installed on the second bar section. The second bar section may also have a threaded portion for engaging mating threads on an interior surface of the collar.

The invention also includes a method for exercising using the apparatus as described herein. The method comprises: a user gripping the apparatus with one hand on the gripping end thereof and gripping the apparatus with another hand placed closer to the hammer head than the first hand; and swinging the apparatus so that the hammer head is able to contact a shock-absorbing surface or lifting the apparatus.

In the method, a user can apply a pulling force to the apparatus using the hand placed closer to the hammer head and apply a pushing force to the apparatus using the hand placed on the gripping end to stabilize the weight load of the device so as to provide counter strength training.

The apparatus in the method may be swung in the manner of a sledgehammer, or swung in front of the body in a generally concentric manner. The apparatus may also be lifted by the user. In one embodiment, the method also includes loading at least one weight on the second bar section of the bar body; placing a collar on the bar body so as to secure the at least one weight on the bar body against the hammer head; and locking the collar on the bar body prior to the user gripping the apparatus and swinging or lifting the apparatus. The apparatus is preferably swung multiple times in a swinging method of use.

The exterior surface of the bar body on the gripping end may also comprise a roughened portion to resist slipping from a user's grip when in use. In such embodiment, the method may further comprise moving the apparatus without impact, and holding the apparatus in at least one position or pose while stretching. In such an embodiment, the method may further comprise moving the apparatus without impact for an aerobic effect to the user, or lifting the apparatus from a starting point in a first direction to a tipping point at or below a shoulder of the user and allowing the apparatus to return with gravity to the starting point in a direction opposite the first direction.

BRIEF DESCRIPTION OF THE SEVERAL VIEWS OF THE DRAWING(S)

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

Figure 1:
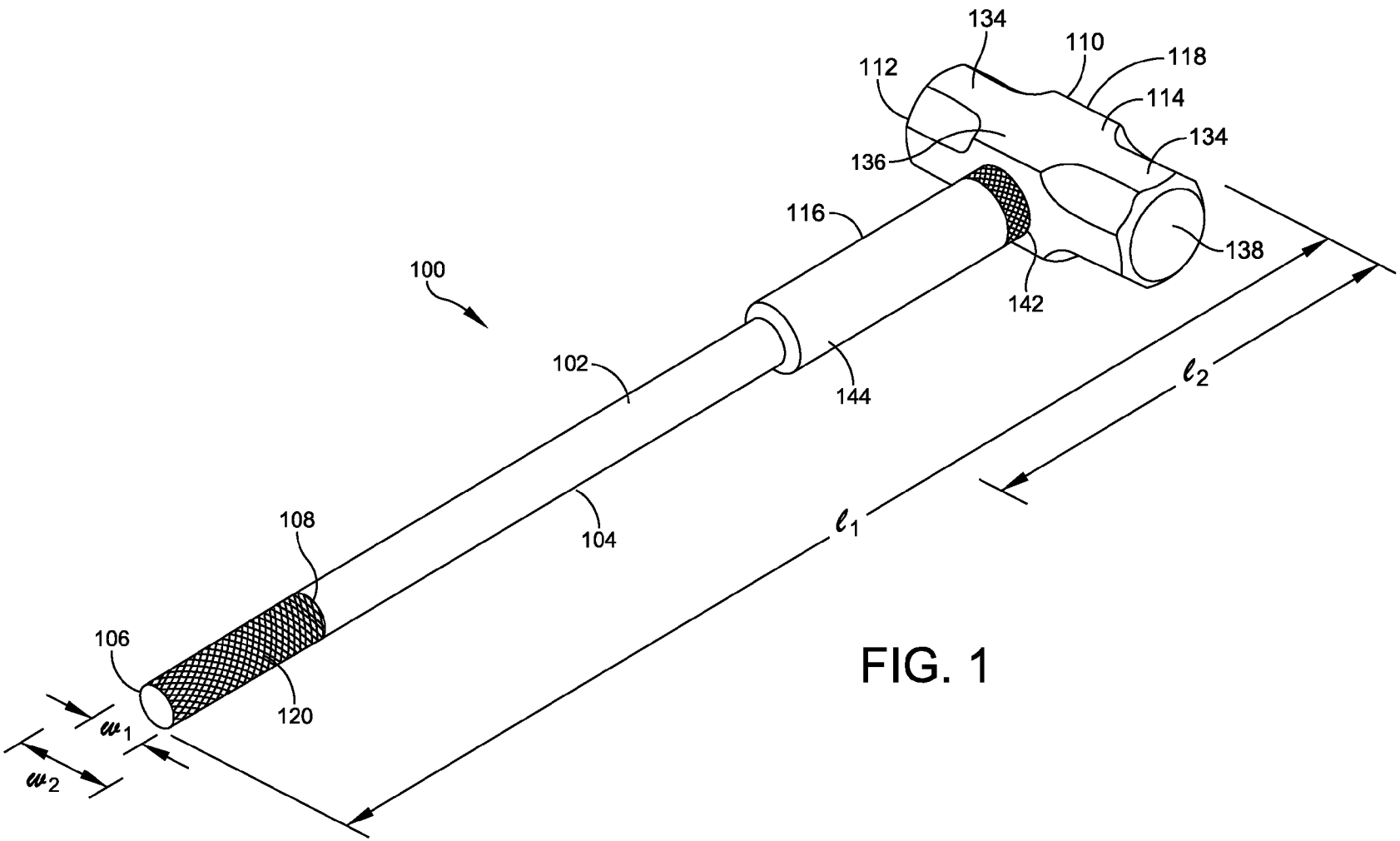
FIG. 1 is a perspective view of an embodiment of the apparatus for exercising herein.
Figure 3:
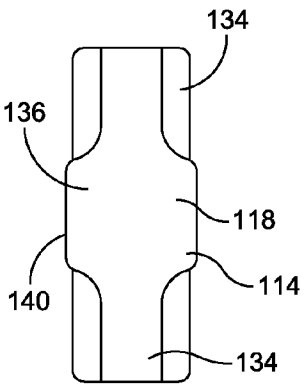
Figure 2:
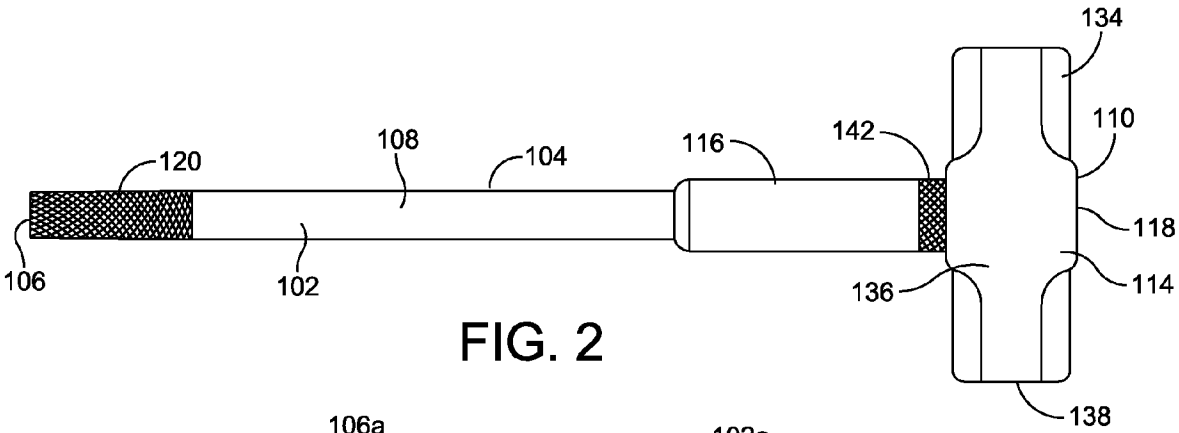
FIG. 2 is a front elevational view of the apparatus of FIG. 1.
Figure 2A:
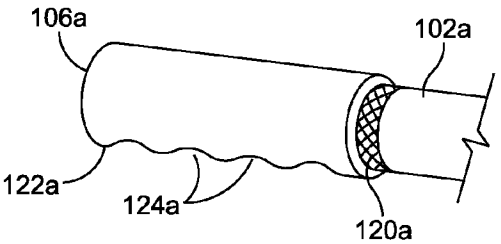
Figure 4:
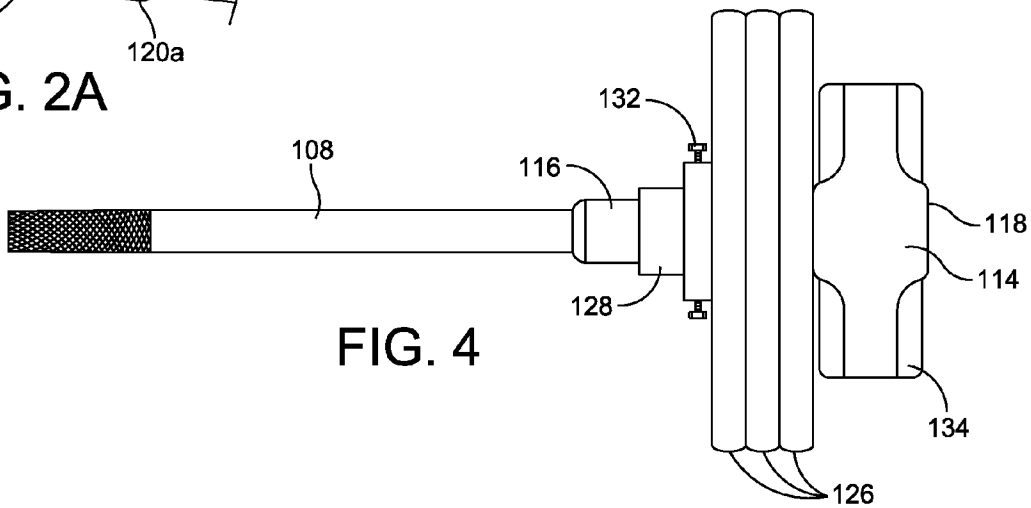
Figure 4A:
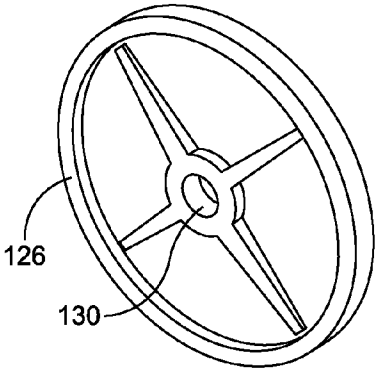
Figure 5:
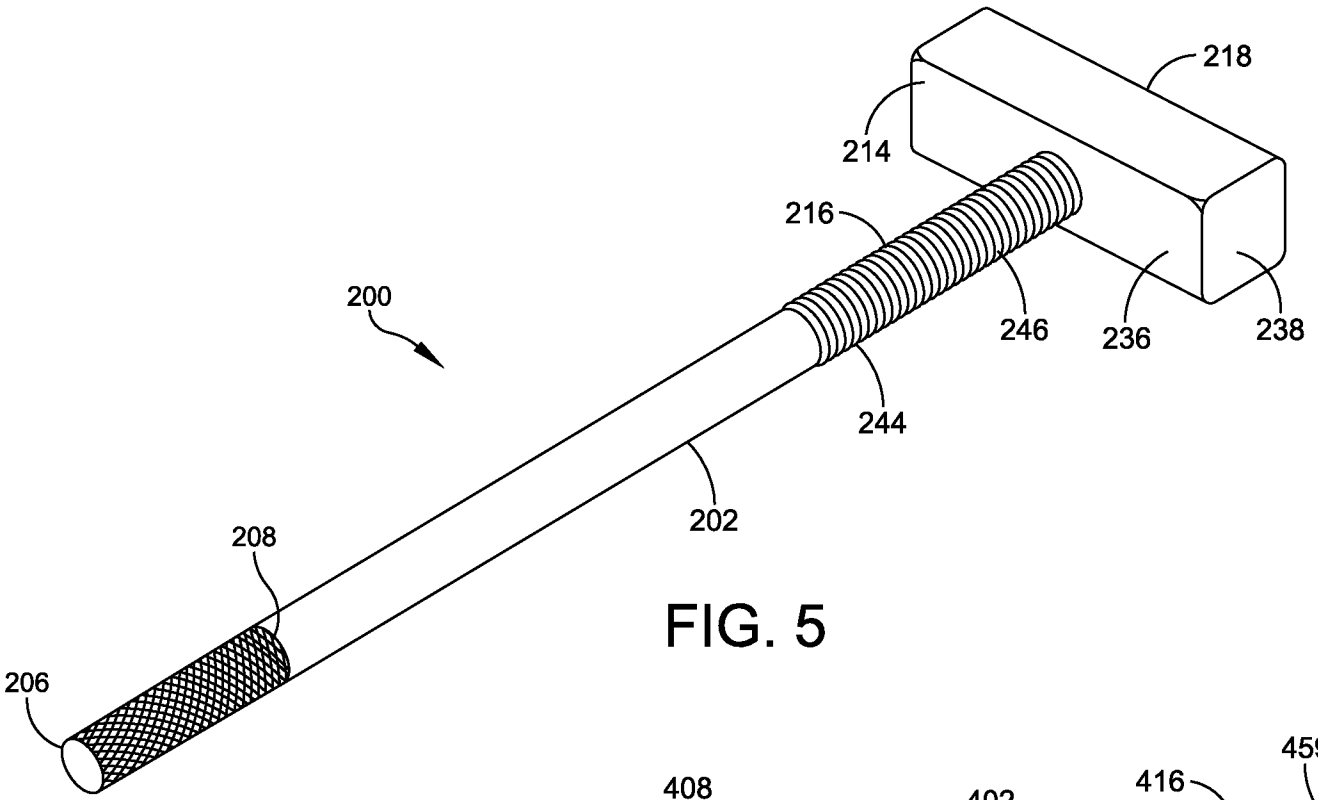
Figure 5A:
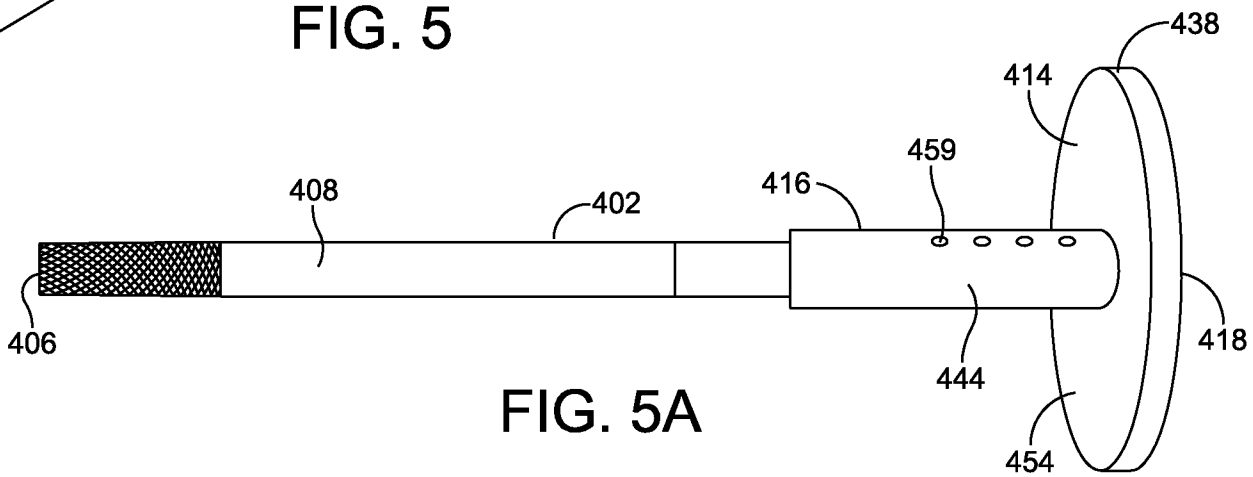

FIG. 2A provides an alternative gripping handle for use with the apparatus of FIG. 1;

FIG. 3 is a top elevational view of the apparatus of FIG. 1;

FIG. 4 is a front elevational view of the apparatus of FIG. 1 having weight discs loaded thereon;

FIG. 4*a* is a perspective view of a weight disc for use in the apparatus herein;

FIG. 5 is a perspective view of another embodiment of an apparatus according to the invention;

FIG. 5A is a perspective view of a further, alternative embodiment of an apparatus according to the invention.

Figure 7:
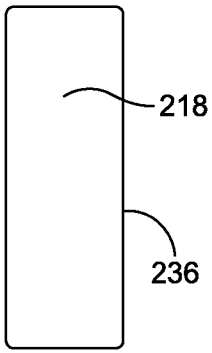
Figure 8A:
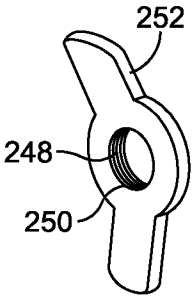
Figure 6:
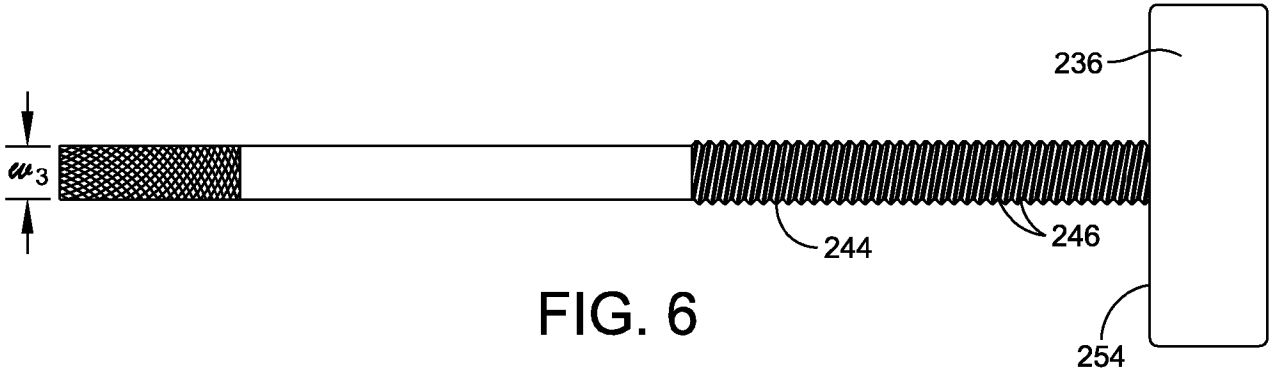
Figure 8:
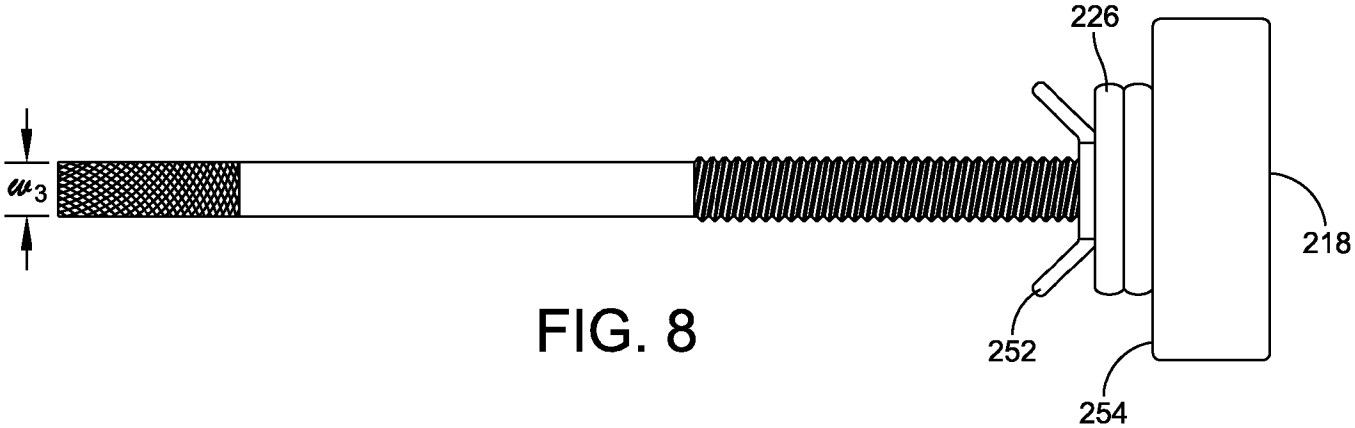
Figure 9:
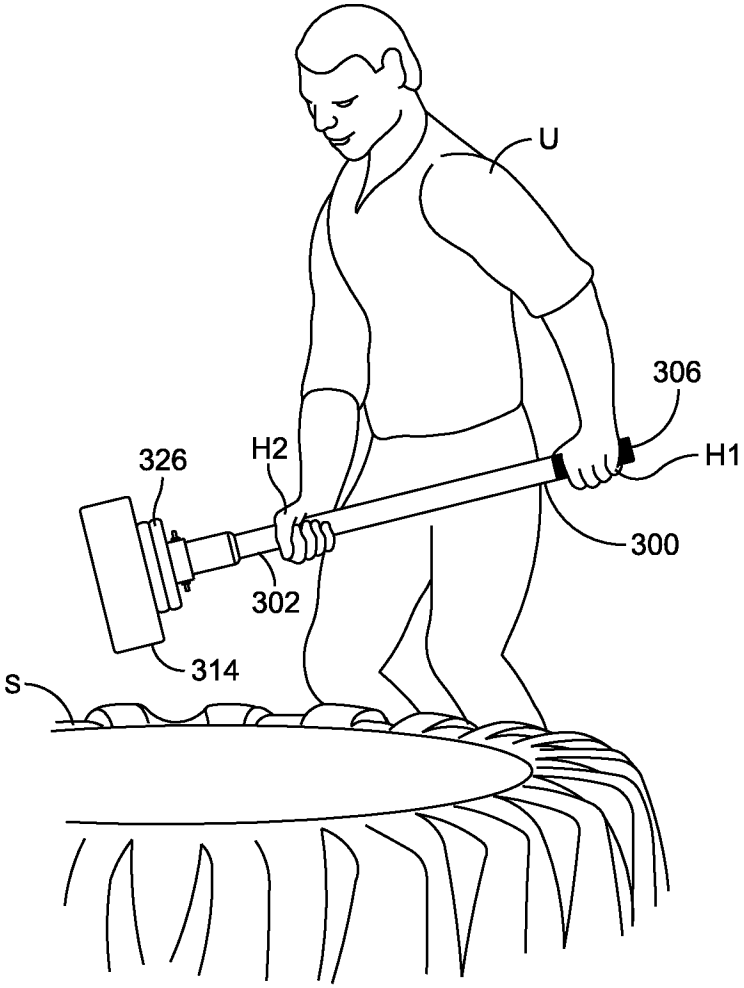

FIG. 6 is a front elevational view of the apparatus of FIG. 5;

FIG. 7 is a top elevational view of the apparatus of FIG. 5;

FIG. 8 is a front elevational view of the apparatus of FIG. 5 having weight discs loaded thereon;

FIG. 8*a* is a perspective view of a screw-on collar for retaining weight discs on the embodiment shown in FIG. 5; and FIG. 9 is a representative view of a user lifting an apparatus as shown in FIG. 1 with weights thereon for beginning an exercise using a sledgehammer swing.

DETAILED DESCRIPTION OF THE INVENTION

As used herein, words such as "upper" and "lower," "left" and "right," "inner" and "outer," "inwardly" and "outwardly," and words of similar import are used herein to describe the invention with reference to the drawings herein to aid in understanding the invention and are not intended to be limiting.

An apparatus is provided herein for use for exercising, physical fitness and strength training. The apparatus may also be used as a variable weight hammer or similar tool for constructions, demolition or worker training, for example, for working in a construction, demolition of other field.

The apparatus is a hammer-like device designed to be useful for fitness or other purposes as noted herein, and which has the ability to hold weight discs for enhanced training or varied application of force. As shown herein with reference to FIG. 1, an embodiment of the apparatus having a sledgehammer-type head is shown and is generally referred to as apparatus 100. It has a longitudinally extending bar body 102 having an exterior surface 104. The bar body 102 is a longer bar configured for a user to readily grip and swing overhand or underhand for fitness as described further hereinbelow. The bar body extends from a gripping end 106 on a first bar section 108 of the bar body 102 to a second end 110 on a hammer portion 112. The hammer portion 112 is configured as a hammer head 114. The bar body 102 also has a second bar section 116 extending from the hammer head 114 at least partially along the bar body 102.

The bar body may be formed of a variety of materials, including in one preferred embodiment a metal or metal alloy material. Specialty polymers or composites using reinforcing fiber or filler may also be used for forming the bar body or at least a portion thereof. It is important that whatever material is chosen be strong enough to resist breaking or deforming under hammering force when swung with impact into a resilient surface and to support additional weight (e.g., weight discs). Preferably the bar body material can support up to about 200 lbs on the bar body in use, but the amount of weight used or supported may be varied as should be apparent based on this disclosure. Preferred materials include stainless steel, iron, iron alloys, titanium, polycarbonate or reinforced polycarbonate composites, ceramic matrix composites, acrylonitrile-butadiene-styrene (ABS) or ABS composites, ultra-high molecular weight polyolefins and composites thereof, such as an ultra-high molecular weight polyethylene (UHMWPE) or its composites, and similar materials.

With reference to FIGS. 1 to 5A, the bar body can have a variety of cross-sectional configurations, including generally rectangular, generally square, generally elliptical, or generally circular, wherein the cross-section is measured in a transverse direction across the bar body. As shown, the bar body 102 has a cross-section that is generally circular. The width $w_1$ of the cross-section, measured in the longest dimension in a transverse direction across the first section 108 of the bar body 102, (which in the case of a generally circular transverse cross-section is a diameter) is preferably about 0.5 in. to about 3 in., about 1 in. to about 2 in., or about 0.5 in. to about 1 in. The width can be varied for various grips, materials of construction and target end uses, e.g., Olympic or standard lifting models, demolition models, hand-held models and the like.

The length $l_1$ of the bar body 102 as measured from a top surface 118 of the hammer head to the gripping end 106 of the first bar section 108 of the bar body 102 in a longitudinal direction along the apparatus 100 can be varied so as to accommodate different sizes for different users (e.g., small to large for varied arm lengths, etc.) or for different models (e.g., a large sized weight lifting apparatus or tool or a smaller hand-held version for lighter exercise or finer work), but for use by most people for a preferred embodiment herein, and based on an average size male user is about 8 in. to about 48 in., more preferably about 16 in. to about 48 in. or about 24 to about 48 in.

The length $l_1$ and width $w_1$ of the bar body are preferably chosen to optimize swing action or lifting action so that when swinging or lifting the bar overhand or underhand by an averaged size male user it is of an appropriate length and gripping size, and to be configured to provide a good hand grip surface on the bar body for an averaged size male user's hands, as well as for structural integrity.

In some embodiments of the apparatus herein, the exterior surface 104 of the bar body 102 on the gripping end 106 comprises an optional roughened portion 120 to resist slipping from a user's grip when in use. The gripping end may also include in addition to or instead of a roughened portion a gripping handle securely attachable or attached to the bar body. An example of such a handle is shown in the alternative handle embodiment in FIG. 2A. The handle 122*a* on gripping end 106*a* of a bar body 102*a* has finger depressions 124*a* to facilitate gripping in use. An optional roughened surface portion 120*a* may also be provided under the handle 122*a* for additional gripping if desired. The invention may also be practiced wherein the gripping end has no gripping handle or roughened area if desired.

The first bar section 108 extends from the gripping end 106 to the second bar section 116. The second bar section 116 is configured for receiving at least one weight, such as a weight disc 126 and, in the embodiment shown, an optional collar 128 for tightening the weight or weights 126 against the hammer head 114. Other methods of tightening may also be used within the scope of the invention (such as detents, centripetal stops and the like). As shown in the alternative embodiment of FIG. 5A, optional holes may be provided to receive pins as well. Friction fit weights may also be used and/or the user may simply hold the weights against the hammer head relying at least in part on centripedal force to retain the weights on the bar body, such that the second bar section may have a smooth exterior as well (see embodiment of FIG. 5A having a smooth exterior and holes which may or may not be provided for weight retention pins).

Preferably the second bar section 116 has a slightly larger width $w_2$ than the width $w_1$ of the first bar section 108 in one embodiment herein. The second bar section may have the same width as the first bar section, but as shown in the embodiment of FIG. 1, the second bar section 116 may instead reinforced and sized and configured to be a bit wider so as to fit within an opening 130 of a weight disc(s) 126 so that the disc(s) 126 fit comfortably and conformingly over the second bar section 116. If a larger width $w_2$ is used for the second bar section 116, the width $w_2$ is preferably about 1 in. to about 4 in., and more preferably about 1 in. to about 2 in. The length $l_2$ of the second bar section 116 is preferably long enough to accommodate approximately 1 to about 8 weight discs or plates of about 2.5 lbs. to about 45 lbs, although the apparatus can be made to accommodate larger sized plates if desired. For example, in some embodiments, the user may load 2.5 lb. to 25 lb. plates. Preferably, the apparatus can accommodate about 200 or so additional lbs. Such plates may be standard plates (1 in.) or Olympic plates (2 in.).

The weight discs 126 if used can be retained on the second bar section 116 as noted above in a variety of ways (holes and retention pins, friction-fit, user holding on a smooth surface, etc.). As shown, the weight discs 126 may be held in place using any acceptable, optional weight collar such as weight collar 128 as shown in FIG. 4, which is attached by constriction bolts 132. However, other weight collars are known in the barbell and weight-lifting art and may be used, or other techniques for holding the weights on may be employed without departing from or limiting the scope of the invention.

The second bar section 116 of the bar body 102 is preferably integral with the first bar section 108 of the bar body and more preferably they form a unitary one-piece structure with the first bar section of the bar body. However, it is within the scope of the invention, as should be understood based on this disclosure to form the apparatus wherein the first and second sections of the bar body of integral but formed of separate pieces welded or mechanically attached together. In addition, a telescoping bar may also be formed for easy collapse and expandable use. The second bar section 116 may also have an optional at least partially roughened portion 142 of the exterior surface 144 of the second bar section 116 to resist slipping of weights when installed on the second bar section or throughout the section 116, however, such a section is optional.

With reference to the hammer head 114 as shown in FIG. 1, the configuration is similar to a more typical sledge hammer configuration having a generally circular in transverse cross section on the extending portions 136 thereof. The generally circular transverse cross-section can be roughly round or generally octagonal with a flat end surface 138. The middle portion of the hammer head can be somewhat flat or slightly curved along the side surfaces 140 thereof and is preferably generally flat along the top surface 118. The hammer head in this embodiment preferably weighs from about 8 lbs. to about 20 lbs., and more preferably about 8 lbs. to about 10 lbs.

As shown in FIGS. 5 to 9, a further embodiment of the apparatus herein is shown, and is generally referred to herein as apparatus 200. Reference numbers in this embodiment are analogous to those of embodiment 100, except to the extent noted here. The bar body 202 of this embodiment extends from a gripping end 206 to the top surface 218 of the hammer head 214. The first bar section 208 of the bar body 202 is generally the same and may be formed analogously to that of the first apparatus 100 shown in FIG. 1. However, the second bar section 216 in this embodiment has an outer surface 244 having threads 246 configured to receive mating threads 248 on an interior surface 250 of a screw-on weight retention collar 252.

In the embodiment of FIG. 6, the hammer head 214 is preferably configured to be more elongated and so as to be generally square in cross section taken in a transverse direction across the hammer head. Additional cross-sectional shapes can also be used, however, the square or rectangular configurations are among the preferred embodiments as they provide flat and stable surfaces 254 for contacting the weight discs 226. As shown, the side surfaces 236 and the end surfaces 238 are also preferably generally flat for contacting a resilient surface. Thus, the hammer head of FIG. 6 is also configured so as to be generally rectangular in longitudinal cross section.

Threads 246 are preferably positioned along at least a portion 256 of the exterior of the second bar section of the bar body and on the collar 252 for tightening weights against the generally flat surface 254 of the hammer head 214. The collar is preferably a spin collar or screw-on collar that has an opening 258 to fit over the bar body 202 and onto the threaded portion. The mating threads 246, 248 on each of the portion 256 of the second bar section and the interior surface 250 of the collar respectively may be cut in any standard manner and either may be the female receiving threads providing that an easy screw-on effect is achieved.

The bar body 202 of the embodiment of FIG. 5 has approximately the same width $w_3$ along its length up to the hammer head 214. The width can be such that it may flare out slightly as it approaches the hammer head if desired. The length of the bar body 202 is preferably the same as $l_1$ shown in FIG. 1, and the bar body 202 and hammer head 214 may be formed of the same materials as noted above. The weight of the hammer head in this embodiment is preferably about 8 lbs. to about 20 lbs., and more preferably about 8 lbs. to about 10 lbs.

A further embodiment of the apparatus, embodiment 400, is shown in FIG. 5A. It is similar to that of FIG. 1, and analogous reference numbers refer to analogous parts, however, the hammer head 414 is more disc-shaped. The hammer head 414 has a striking surface 438 that is curved as the cross section of the head 414 measured in the transverse direction is generally circular and the cross section of the head 414 measured in the longitudinal direction is generally rectangular. Thus the top surface 418 and weight-facing bottom surface 254 of the head 414 appear circular as well. The disc head 414 may have a preferred width (thickness) of about 1 in. to about 4 in., preferably about 2 in. to about 3 in. and a preferred diameter of about 7 to about 10 in., preferably about 8 in. to about 9 in.

The embodiment shown in FIG. 5A also has a second bar section 416 has a smooth exterior surface 444. Optional holes 459 may be provided for receiving weight retention pins as are known in the art. However, centripedal force and the user's hands as well as optionally a friction weight fit, may be used to hold or retain weights on the smoother exterior surface 444 without such holes. The smoother look may be provided by use of composites as noted above. As shown, the second bar section 416 is larger in width than the first bar section 408 and there is no transition area. Thus the second bar section 416 may be molded from composites more easily to have a width to fit a desired weight type. An optional roughened gripping end 406 is shown, but the gripping end of the bar body may also be smooth as noted above.

An assembly apparatus as shown, for example in either FIG. 4 or 8 can be provided as well within the scope of the invention herein which is useful for strength training or other uses as noted above herein, and includes a strength training apparatus or tool which may be the same or similar to the embodiments described herein in FIGS. 1 through 6 and their related views. The assembly further includes at least one weight disc having an opening therethrough, as described above and as shown in FIGS. 4, 4A and 8 which is sized to fit over the exterior surface of the bar body including the second bar body section thereof. The assembly may also include an optional collar or other device if desired configured to retain the at least one weight disc on the bar body. Examples of suitable collars are described above and shown in FIGS. 4, 8 and 8A.

The assembly may include any of the features of the embodiments described herein or similar features.

A method for exercising is also described herein, which may be carried out using any of the apparatuses described herein and their assemblies. In the method, as shown, for example in FIG. 10, a user U is using a hybrid embodiment 300 of the two apparatus embodiments noted above, in that embodiment 300 includes a bar body 302 having first and second bar body sections having a handle shaped and configured as in FIG. 1 and a hammer head 314 as configured in FIG. 5. The user U lifts the apparatus 300 and grips the apparatus with at least one hand H1 on the gripping end 306 thereof. The user U also grips the apparatus 300 with the other hand H2 placed closer to the hammer head 314 than the first hand is for driving the hammer, however, the hand H2 may be positioned anywhere along the bar body for control. It is preferred that it be closer to the hammer head at first to support any weights such as weights 326 to lift and support the user's back. The user U is preferably also using a weight belt (not shown) and pushing upwards using leg as well as arm and other muscles and tightening the core muscles for a whole body work-out. As the user lifts the apparatus 300, the hand H2 can slide down the bar body further back toward the gripping end for completing certain exercises, or may remain in its original position. The gripping hand H1 and user hand H2 may be a user's right or left hand depending on user preference and/or hand dominance for driving or controlling the hammer's operation.

The user then can complete a series of varied exercises by swinging motions using an apparatus according to the invention. In one embodiment, the hammer apparatus is swung overhand and lifted up above the head and behind the user so that the gripping portion is held by the user above and preferably behind the head so that any weights and the hammer head are pushed behind the user. The user than swings the weights forward in a motion like a sledge hammer swing into a resilient surface or object. As shown in FIG. 9, the resilient surface S is a tire. The surface S if a tire or similar object can be filled with further resilient objects such as wood blocks or other objects. It is preferred that the resilient surface S is a rubber, wood, foam mat(s), or other shock-absorbing material to resist too much reverse impact on the user other than the force of impact. Other resilient surfaces (padded shapes, etc.) or shock-absorbing targets for accuracy swinging may be used as well. The user can vary the swing from different angles, different hands on the gripping end, and the like to obtain a balanced core and whole body workout.

In one embodiment, preferably using an apparatus having a gripping surface, a user may employ the apparatus herein for counter-strength training, wherein the hand H2 nearest the hammer head applies a pulling force against gravity and the other hand H1 applies a pushing force to stabilize the load when lifting or beginning a swing. Again, either hand may be used for either task. The user can just hold in the position for a period of time as well for simply applying counter-strength training. In typical weight-lifting, the movement has two parts (positive movement and negative return movement), however, both hands are typically moving along the same directional paths. In this counter-strength training technique, the user can push or pull in opposite directions for the lifting (i.e., an underhand and overhand pull and push operation).

Other exercises are contemplated herein as well. For example, the hammer head can be swung down and low in front of the body in a generally concentric manner for an underhand swing. This type of workout also strengthens the core and provides excellent upper body work out as well. In the method, at least one weight may be loaded on the second bar section of the bar body according to the various embodiments described herein. A collar, such as a collar having locking pins or a screw-on collar may be used to secure the at least one weight on the bar body against the hammer head. The collar should be locked on bar body prior to the user gripping the apparatus and swinging it and its tightness checked to ensure the weights are secure prior to using. As with other exercises, the underhand swinging exercises may be repeated multiple times. Other exercises are also contemplated as being within the scope of the invention provided they incorporate the apparatus of the present invention.

In yet other embodiments, an apparatus having a roughened gripping portion or other gripping portion can be simply moved with or without weights without impact to hold in various poses for stretching exercises. Using a similar apparatus within the scope of the disclosure herein, the user may also engage in "slam-training," in which the apparatus is lifted from a starting position to a "tipping point" preferably at or below the shoulder against the force of gravity and then, with the force of gravity, it is dropped back down to the starting point (slammed). This type of training mimics the type of force used by a linebacker to tackle and lift a quarterback and then slam him or her to the ground. Thus, it can be used for similar sports training. The apparatus can also be used with or without weights simply for moving around for aerobic and/or low impact workouts as well.

In use as a tool for construction, demolition and the like, weights can be employed to take a hammer tool and make it a variable weight tool so that one tool can perform multiple tasks that may require different force of impact. Thus only one tool and various weights can be brought to a site for working without having to know in advance what specific weight tools are required for demolition, pile driving, rivet driving, nail driving, breaking up stone, etc.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A apparatus, comprising:

a longitudinally extending bar body having an exterior surface and extending from a gripping end on a first bar section thereof to a second end comprising a hammer portion;

wherein the hammer portion of the second end of the bar body comprises a hammer head and the bar body comprises a second bar section extending from the hammer head at least partially along the bar body configured for receiving at least one weight for positioning adjacent the hammer head, wherein the second bar section of the bar body extending from the hammer head along the bar body has a width measured in a transverse direction that is larger than a width of the first bar section.

2. The apparatus according to claim 1, further comprising a collar for tightening at least one weight against the hammer head.

3. The apparatus according to claim 1, wherein the apparatus is a strength training apparatus.

4. The apparatus according to claim 1, wherein the apparatus is a construction or demolition tool capable of supporting variable weight.

5. The apparatus according to claim 1, wherein the apparatus is a strength training device for training workers.

6. The apparatus according to claim 1, wherein the bar body comprises metal.

7. The apparatus according to claim 1, wherein the bar body has a generally circular cross-section taken in a transverse direction across the bar body.

8. The apparatus according to claim 1, wherein the exterior surface of the bar body on the gripping end comprises a roughened portion to resist slipping from a user's grip when in use.

9. The apparatus according to claim 1, wherein the gripping end comprises a gripping handle securely attachable or attached to the bar body.

10. The apparatus according to claim 1, wherein the second bar section of the bar body is integral with the first bar section of the bar body.

11. The apparatus according to claim 9, wherein the second bar section of the bar body is a unitary one-piece structure with the first bar section of the bar body.

12. The apparatus according to claim 1, wherein the hammer head is configured so as to be generally circular in transverse cross section on extending portions thereof.

13. The apparatus according to claim 1, wherein the hammer head is configured so as to be generally square in cross section taken in a transverse direction across the hammer head.

14. The apparatus according to claim 12, wherein the hammer head is configured so as to be generally rectangular in cross section taken in a longitudinal direction across the hammer head.

15. The apparatus according to claim 1, wherein the hammer head is configured so as to be generally rectangular in cross section taken in a longitudinal direction across the hammer head and generally circular in cross-section taken in a transverse direction across the hammer head so that the hammer head is generally disc-shaped.

16. The apparatus according to claim 1, wherein the second bar section has an at least partially roughened exterior surface to resist slipping of weights when installed on the second bar section.

17. The apparatus according to claim 1, wherein the second bar section comprises threads along at least a portion of the exterior surface in the second bar section of the bar body for engaging mating threads on a collar for tightening weights against the hammer head.

18. The apparatus according to claim 1, wherein the second bar section is configured to have a width for receiving weight discs and that is larger than a width of the first bar section, but which has a smooth exterior surface.

19. The apparatus according to claim 1, wherein a length of the bar body measured from a top surface of the hammer head to a gripping end of the first bar section of the bar body in a longitudinal direction along the apparatus is about 16 in. to about 48 in.

20. The apparatus according to claim 1, wherein a length of the second bar section of the bar body measured in a longitudinal direction along the apparatus is about 4 in. to about 20 in.

21. The apparatus according to claim 1, wherein a width measured transversely across the bar body in the first bar section thereof is about 0.5 in. to about 3 in.

22. The apparatus according to claim 1, wherein a width measured transversely across the bar body in the second bar section thereof is about 1 in. to about 4 in.

23. The apparatus according to claim 1, wherein a weight of the apparatus is about 5 lbs. to about 60 lbs.

24. A assembly apparatus, comprising (a) a hammer head apparatus comprising:

a longitudinally extending bar body having an exterior surface and extending from a first gripping end on a first bar section thereof to a second end comprising a hammer portion;

wherein the hammer portion of the second end of the bar body comprises a hammer head and the bar body comprises a second bar section extending from the hammer head at least partially along the bar body, the second bar section configured for receiving at least one weight and a collar for tightening at least one weight against the hammer head, wherein the second bar section of the bar body has a width that is larger than a width of the first bar section; and (b) at least one weight disc having an opening therethrough sized to fit over the exterior surface of the bar body in the second bar body section thereof.

25. The assembly apparatus according to claim 24, further comprising a collar configured to retain the at least one weight disc on the bar body.

26. The assembly apparatus according to claim 25, wherein the second bar section has a threaded portion for engaging mating threads on an interior surface of the collar.

27. A method for exercising using the apparatus according to claim 1, the method comprising:

a user gripping the apparatus with one hand on the gripping end thereof and gripping the apparatus with another hand placed closer to the hammer head than the first hand; and swinging the apparatus so that the hammer head is able to contact a shock-absorbing surface or lifting the apparatus.

28. The method for exercising according to claim 27, wherein the user applies a pulling force to the apparatus using the hand placed closer to the hammer head and applies a pushing force to the apparatus using the hand placed on the gripping end to stabilize the weight load of the device so as to provide a counter strength training.

29. The method for exercising according to claim 27, wherein the apparatus is swung in the manner of a sledgehammer.

30. The method for exercising according to claim 27, wherein the apparatus is swung in front of the body in a generally concentric manner.

31. The method for exercising according to claim 27, wherein the apparatus is lifted by the user.

32. The method for exercising according to claim 27, further comprising:

loading at least one weight on the second bar section of the bar body;

placing a collar on the bar body so as to secure the at least one weight on the bar body against the hammer head; and locking the collar on the bar body prior to the user gripping the apparatus and swinging or lifting the apparatus.

33. The method for exercising according to claim 32, wherein the apparatus is swung multiple times.

34. The method for exercising according to claim 27, wherein the exterior surface of the bar body on the gripping end comprises a roughened portion to resist slipping from a user's grip when in use and the method further comprises moving the apparatus without impact, and holding the apparatus in at least one position or pose while stretching.

35. The method for exercising according to claim 27, wherein the exterior surface of the bar body on the gripping end comprises a roughened portion to resist slipping from a user's grip when in use and the method further comprises moving the apparatus without impact for an aerobic effect to the user.

36. The method for exercising according to claim 27, wherein the exterior surface of the bar body on the gripping end comprises a roughened portion to resist slipping from a user's grip when in use and the method further comprises lifting the apparatus from a starting point in a first direction to a tipping point at or below a shoulder of the user and allowing the apparatus to return with gravity to the starting point in a direction opposite the first direction.

* * * * *